US011410676B2

(12) United States Patent
Santana et al.

(10) Patent No.: US 11,410,676 B2
(45) Date of Patent: Aug. 9, 2022

(54) SOUND MONITORING AND USER ASSISTANCE METHODS FOR A MICROWAVE OVEN

(71) Applicant: Haier US Appliance Solutions, Inc., Wilmington, DE (US)

(72) Inventors: Omar Santana, Louisville, KY (US); John Michael Todd, Mount Washington, KY (US); Seog-Tae Kim, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/951,314

(22) Filed: Nov. 18, 2020

(65) Prior Publication Data

US 2022/0157331 A1 May 19, 2022

(51) Int. Cl.

| | |
|---|---|
| ***G10L 25/51*** | (2013.01) |
| ***H05B 6/64*** | (2006.01) |
| ***H04R 1/08*** | (2006.01) |

(52) U.S. Cl.

CPC ..... *G10L 25/51* (2013.01); *H04R 1/08* (2013.01); *H05B 6/6435* (2013.01); *H05B 6/6447* (2013.01)

(58) Field of Classification Search

None

See application file for complete search history.

(56) References Cited

U.S. PATENT DOCUMENTS

| | | | | |
|---|---|---|---|---|
| 8,717,188 | B2 | 5/2014 | Han et al. | |
| 8,981,930 | B2 * | 3/2015 | Horstemeyer | G08B 21/18 340/539.14 |
| 9,386,140 | B2 | 7/2016 | Logan et al. | |
| 10,294,600 | B2 | 5/2019 | Beals | |
| 10,871,943 | B1 * | 12/2020 | D'Amato | H04L 12/2809 |
| 2003/0095673 | A1 * | 5/2003 | Colmenarez | G10L 15/22 704/E15.04 |
| 2013/0066593 | A1 * | 3/2013 | Kim | H04L 12/2836 702/182 |
| 2014/0006953 | A1 * | 1/2014 | Kim | G06F 3/167 715/727 |
| 2015/0043737 | A1 * | 2/2015 | Abe | G10L 25/18 381/56 |
| 2015/0105880 | A1 | 4/2015 | Slupik. et al. | |
| 2016/0006576 | A1 * | 1/2016 | Matsuzaki | G06F 13/00 709/224 |
| 2016/0036958 | A1 | 2/2016 | Logan et al. | |

(Continued)

FOREIGN PATENT DOCUMENTS

| | | | |
|---|---|---|---|
| DE | 102007058936 | A1 | 6/2009 |
| DE | 102017214598 | A1 | 2/2019 |

*Primary Examiner* — Paul W Huber

(74) *Attorney, Agent, or Firm* — Dority & Manning, P.A.

(57) ABSTRACT

A sound sensing module for monitoring the operation of an appliance includes a microphone for monitoring sound generated during operation of the appliance and a controller operably coupled to the microphone. The controller can obtain a sound signal generated during operation of the appliance, analyze the sound signal to identify a sound signature corresponding to an operating event, and implement a responsive action, such as providing a user notification, providing troubleshooting instructions, ordering a replacement part, scheduling a maintenance visit.

17 Claims, 6 Drawing Sheets

(56) References Cited

U.S. PATENT DOCUMENTS

| | | | | |
|---|---|---|---|---|
| 2016/0117905 | A1* | 4/2016 | Powley | H04R 1/08 340/521 |
| 2016/0247128 | A1* | 8/2016 | Horstemeyer | H04L 67/125 |
| 2017/0004684 | A1* | 1/2017 | Slater | G08B 7/06 |
| 2018/0228006 | A1* | 8/2018 | Baker | G10L 15/22 |
| 2018/0252795 | A1* | 9/2018 | Kumar | G01S 1/725 |
| 2018/0302730 | A1* | 10/2018 | Liu | H04R 29/00 |
| 2018/0336512 | A1* | 11/2018 | Clarke | G06Q 50/28 |
| 2019/0190739 | A1* | 6/2019 | Guinard | G06N 20/00 |
| 2020/0090644 | A1* | 3/2020 | Klingler | G06N 3/08 |
| 2021/0020018 | A1* | 1/2021 | Kim | G08B 7/06 |

* cited by examiner

SOUND MONITORING AND USER ASSISTANCE METHODS FOR A MICROWAVE OVEN

FIELD OF THE INVENTION

The present subject matter relates generally to microwave oven appliances, and more particularly, to methods of monitoring sounds and providing user assistance to a user of a microwave appliance.

BACKGROUND OF THE INVENTION

Appliances commonly generate a variety of noises during or after an operating cycle, in the event of a fault or service need, and in other circumstances. For example, a microwave oven may generate a unique sequence of beeps, sounds, or other noises to indicate the start of an operating cycle, the end of an operating cycle, the occurrence of an event or a fault condition, etc. Moreover, other appliances also generate sounds specific to their particular events, faults, failures, etc. Notably, these sounds are often unique, associated within a particular appliance, and generally represent the existence of a condition or the occurrence of an event.

However, conventional appliances are passive and non-responsive to these generated sounds. Notably, it is frequently desirable to monitor sounds generated by a microwave oven during operation or sounds generated by other appliances near the microwave oven, e.g., to identify operating events to diagnose service issues, etc. However, conventional microwave ovens and other appliances lack any sound feedback systems. For example, while a microwave oven may generate a beep to indicate the end of an operating cycle, this beep is intended solely as an audible indicator to a user of the appliance. In addition, the microwave oven might generate noises that indicate a dangerous operating condition or a malfunction, but such noises are not commonly monitored or detected such that corrective action may be initiated.

Accordingly, a microwave oven with features for improved operation would be desirable. More specifically, a system and method for monitoring sounds generated by a microwave oven or nearby appliances and identifying sound signatures associated with particular operating conditions would be particularly beneficial.

BRIEF DESCRIPTION OF THE INVENTION

Advantages of the invention will be set forth in part in the following description, or may be apparent from the description, or may be learned through practice of the invention.

In one exemplary embodiment, a sound sensing module for monitoring the operation of an appliance is provided. The sound sensing module includes a microphone for monitoring sound generated during operation of the appliance and a controller operably coupled to the microphone. The controller is configured to obtain a sound signal generated during operation of the appliance using the microphone, identify a sound signature by analyzing the sound signal, the sound signature corresponding to an operating event of the appliance, and implement a responsive action based at least in part on the identification of the sound signature.

In another exemplary embodiment, a method of monitoring the operation of an appliance using a sound sensing module is provided. The sound sensing module includes a microphone and the method includes obtaining a sound signal generated during operation of the appliance using the microphone, identifying a sound signature by analyzing the sound signal, the sound signature corresponding to an operating event of the appliance, and implementing a responsive action based at least in part on the identification of the sound signature.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
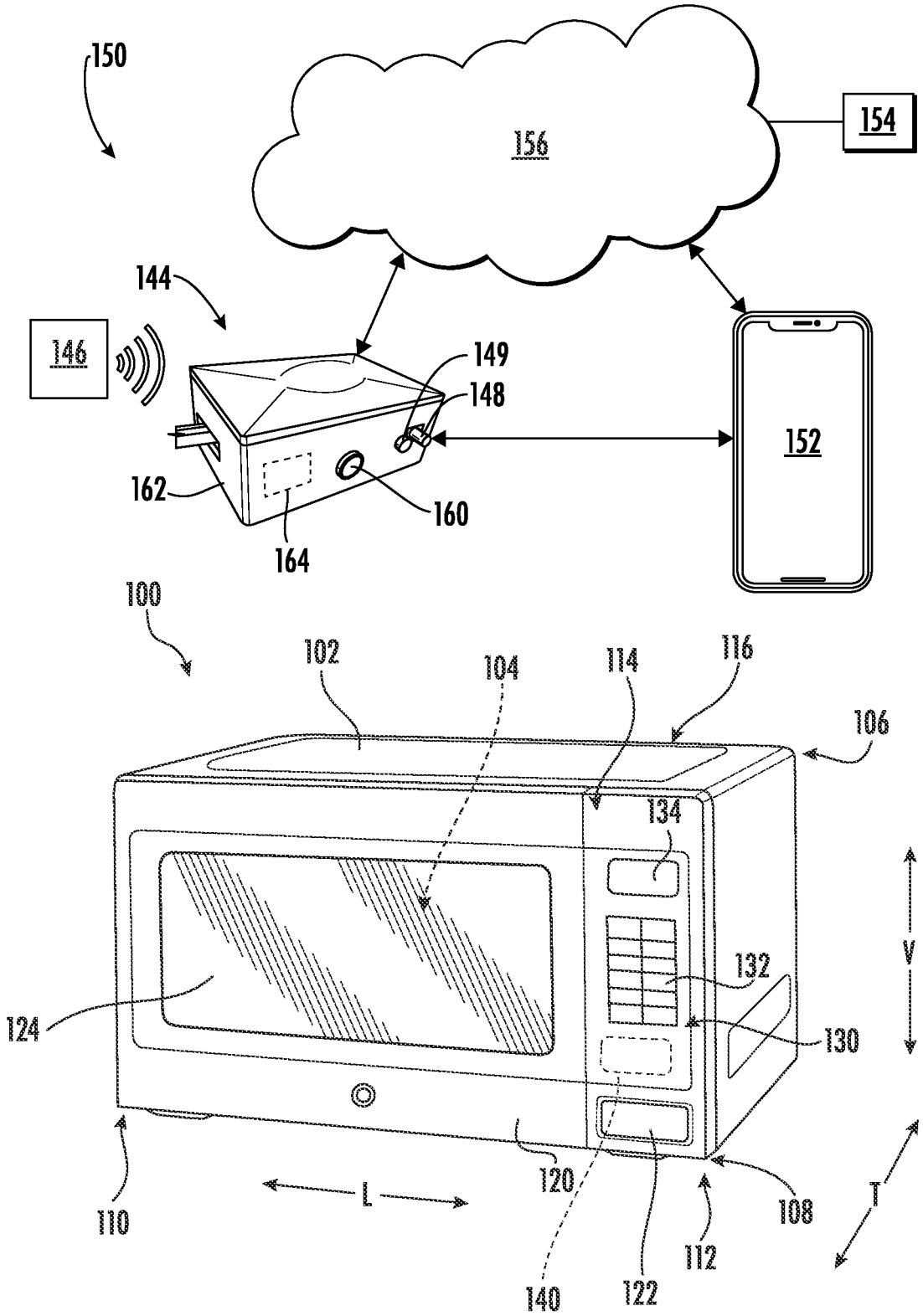
FIG. 1 provides a perspective view of a microwave oven appliance in accordance with an example embodiment of the present disclosure.
Figure 2:
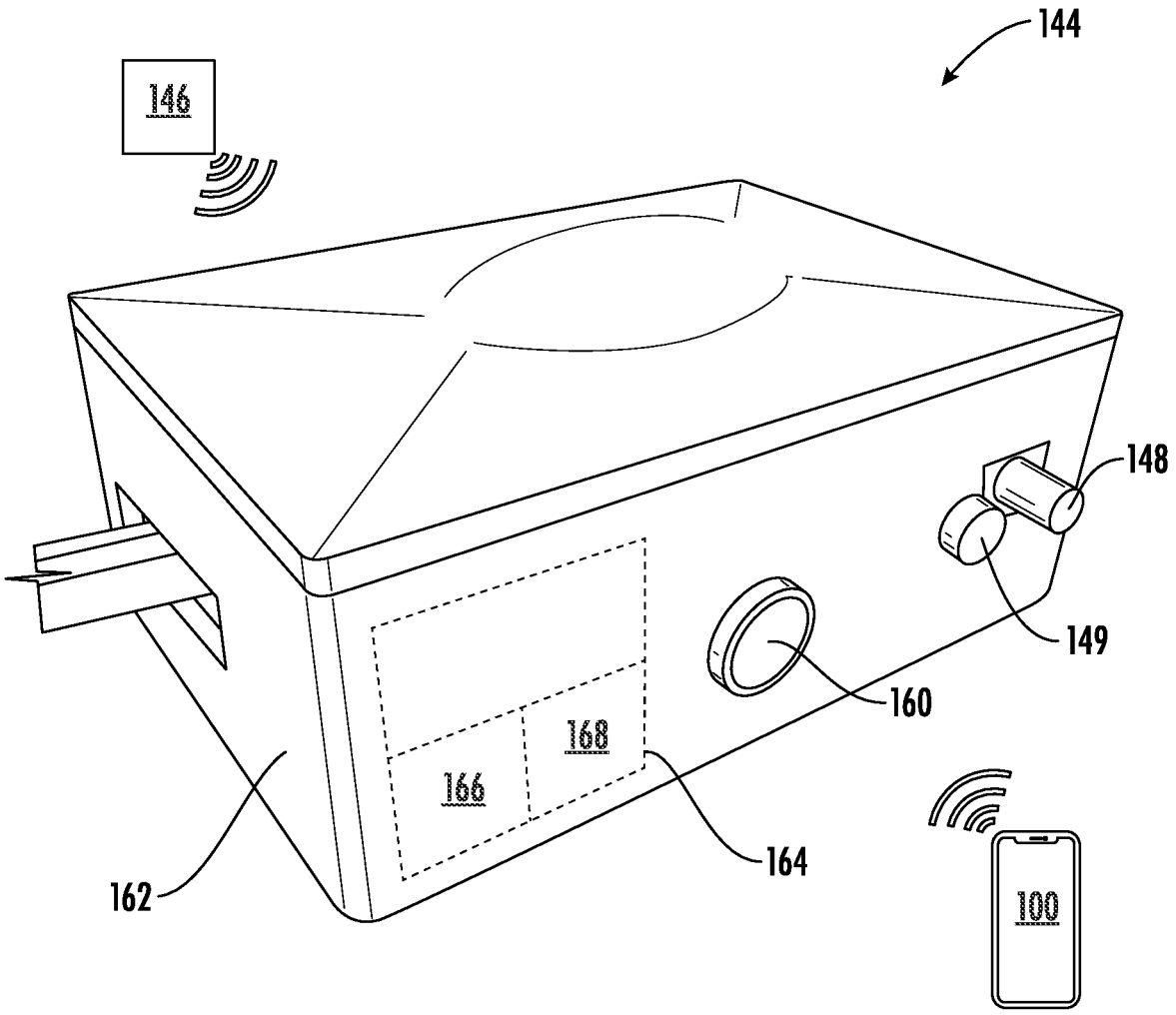
FIG. 2 provides a perspective view of a sound sensing module that may be used with the exemplary microwave oven of FIG. 1 according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a front, perspective view of a microwave oven 100 as may be employed with the present subject matter. Microwave oven 100 includes an insulated cabinet 102. Cabinet 102 defines a cooking chamber 104 for receipt of food items for cooking. As will be understood by those skilled in the art, microwave oven 100 is provided by way of example only, and the present subject matter may be used in any suitable microwave oven, such as a countertop microwave oven, an over-the-range microwave oven, etc. In addition, aspects of the present subject matter may be used in other suitable residential or commercial appliances, e.g., a gas or electric oven range appliance, a dishwasher, a washing machine, a refrigerator appliance, etc. Thus, the example embodiment shown in FIG. 1 is not intended to limit the present subject matter to any particular cooking chamber configuration or arrangement.

As illustrated, microwave oven 100 generally defines a vertical direction V, a lateral direction L, and a transverse direction T, each of which is mutually perpendicular, such that an orthogonal coordinate system is generally defined. Cabinet 102 of microwave oven 100 extends between a top 106 and a bottom 108 along the vertical direction V, between a first side 110 (left side when viewed from front) and a second side 112 (right side when viewed from front) along the lateral direction L, and between a front 114 and a rear 116 along the transverse direction T.

Microwave oven 100 includes a door 120 that is rotatably attached to cabinet 102 in order to permit selective access to cooking chamber 104. A handle may be mounted to door 120 to assist a user with opening and closing door 120 in order to access cooking chamber 104. As an example, a user can pull on the handle mounted to door 120 to open or close door 120 and access cooking chamber 104. Alternatively, microwave oven 100 may include a door release button 122 that disengages or otherwise pushes open door 120 when depressed. Glass window panes 124 provide for viewing the contents of cooking chamber 104 when door 120 is closed and also assist with insulating cooking chamber 104.

Microwave oven 100 is generally configured to heat articles, e.g., food or beverages, within cooking chamber 104 using electromagnetic radiation. Microwave appliance 100 may include various components which operate to produce the electromagnetic radiation, as is generally understood. For example, microwave appliance 100 may include a magnetron (such as, for example, a cavity magnetron), a high voltage transformer, a high voltage capacitor and a high voltage diode. The transformer may provide energy from a suitable energy source (such as an electrical outlet) to the magnetron. The magnetron may convert the energy to electromagnetic radiation, specifically microwave radiation. The capacitor generally connects the magnetron and transformer, such as via high voltage diode, to a chassis. Microwave radiation produced by the magnetron may be transmitted through a waveguide to the cooking chamber.

The structure and intended function of microwave ovens are generally understood by those of ordinary skill in the art and are not described in further detail herein. According to alternative embodiments, microwave oven may include one or more heating elements, such as electric resistance heating elements, gas burners, other microwave heating elements, halogen heating elements, or suitable combinations thereof, are positioned within cooking chamber 104 for heating cooking chamber 104 and food items positioned therein.

Referring again to FIG. 1, a user interface panel 130 and a user input device 132 may be positioned on an exterior of the cabinet 102. The user interface panel 130 may represent a general purpose Input/Output ("GPIO") device or functional block. In some embodiments, the user interface panel 130 may include or be in operative communication with user input device 132, such as one or more of a variety of digital, analog, electrical, mechanical or electro-mechanical input devices including rotary dials, control knobs, push buttons, and touch pads. The user input device 132 is generally positioned proximate to the user interface panel 130, and in some embodiments, the user input device 132 may be positioned on the user interface panel 130. The user interface panel 130 may include a display component 134, such as a digital or analog display device designed to provide operational feedback to a user.

Generally, microwave oven 100 may include a controller 140 in operative communication with the user input device 132. The user interface panel 130 of the microwave oven 100 may be in communication with the controller 140 via, for example, one or more signal lines or shared communication busses, and signals generated in controller 140 operate microwave oven 100 in response to user input via the user input devices 132. Input/Output ("I/O") signals may be routed between controller 140 and various operational components of microwave oven 100. Operation of microwave oven 100 can be regulated by the controller 140 that is operatively coupled to the user interface panel 130.

Controller 140 is a "processing device" or "controller" and may be embodied as described herein. Controller 140 may include a memory and one or more microprocessors, microcontrollers, application-specific integrated circuits (ASICS), CPUs or the like, such as general or special purpose microprocessors operable to execute programming instructions or micro-control code associated with operation of microwave oven 100, and controller 140 is not restricted necessarily to a single element. The memory may represent random access memory such as DRAM, or read only memory such as ROM, electrically erasable, programmable read only memory (EEPROM), or FLASH. In one embodiment, the processor executes programming instructions stored in memory. The memory may be a separate component from the processor or may be included onboard within the processor. Alternatively, a controller 140 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

In addition, referring again to FIG. 1, a sound sensing module 144 may be used to monitor a variety of appliances (identified generally by reference numeral 146), as described in further detail below. In general, sound sensing module 144 may be a standalone device that is mounted near such appliance for monitoring their operation. According to exemplary embodiments, sound sensing module 144 may be either battery-operated or may be plugged into a conventional wall outlet. In addition, sound sensing module 144 may include a push button 148 or other user interfaces that receive user inputs, permit the activation of various methods or modules, enable part ordering or maintenance scheduling, etc. Sound sensing module 144 may further include an indicator 149 for providing user feedback. The methods, notifications, and operations described herein may be configured by the user in any suitable manner. For example, notifications may be enabled and disabled using push button 148 on sound sensing module 144 or through a smart home assistant device or other remote devices such as phone, tablet, PC, etc. These notifications may be fully configurable by a user. In addition, when cycle notifications are enabled, light indicator 149 on sound sensing module 144 may turn on until the events occur. According to exemplary embodiments, a user would need to re-enable cycle notifications to get new notifications.

As shown, sound sensing module 144 may be in operative communication directly or indirectly with an external communication system 150. Moreover, a remote device 152, such as a user's mobile phone, may be in operative communication with sound sensing module 144 through external communication system 150. Specifically, according to an exemplary embodiment, external communication system 150 is configured for enabling communication between a user, sound sensing module 144, and/or a remote server 154. According to exemplary embodiments, sound sensing module 144 may communicate with a remote device 152 either directly (e.g., through a local area network (LAN), Wi-Fi, Bluetooth, etc.) or indirectly (e.g., via a network 156), as well as with remote server 154, e.g., to receive notifications, provide confirmations, input operational data, transmit sound signals and sound signatures, etc.

In general, remote device 152 may be any suitable device for providing and/or receiving communications or commands from a user. In this regard, remote device 152 may include, for example, a personal phone, a tablet, a laptop computer, a smart home assistant (e.g., Google Assistant or Amazon Alexa), or another mobile device. In addition, or alternatively, communication between the appliance and the user may be achieved directly through an appliance control panel (e.g., control panel 130). In general, network 156 can be any type of communication network. For example, network 156 can include one or more of a wireless network, a wired network, a personal area network, a local area network, a wide area network, the internet, a cellular network, etc. In general, communication with network may use any of a variety of communication protocols (e.g., TCP/IP, HTTP, SMTP, FTP), encodings or formats (e.g. HTML, XML), and/or protection schemes (e.g., VPN, secure HTTP, SSL).

External communication system 150 is described herein according to an exemplary embodiment of the present subject matter. However, it should be appreciated that the exemplary functions and configurations of external communication system 150 provided herein are used only as examples to facilitate description of aspects of the present subject matter. System configurations may vary, other communication devices may be used to communicate directly or indirectly with one or more appliances, other communication protocols and steps may be implemented, etc. These variations and modifications are contemplated as within the scope of the present subject matter.

While the operation of sound sensing module 144 is described herein in the context of a specific embodiment for use with a microwave oven 100, using the teachings disclosed herein it will be understood that microwave oven 100 is provided by way of example only. Other residential or commercial appliances may be adapted for use within such a system, and sound sensing module 144 may be configured for monitoring operation of such appliances in a manner similar to that described with respect to microwave oven 100. Moreover, sound sensing module 144 may be configured for monitoring operation of a plurality of appliances having different configurations, different appearances, and/or different features while remaining within the scope of the present subject matter.

According to an exemplary embodiment, sound sensing module 144 includes a microphone 160 that is used for monitoring the sound waves, noises, or other vibrations generated during the operation of microwave oven 100 or any other appliances 146 within audible range of microphone 160. For example, microphone 160 may be one or more microphones, acoustic detection devices, vibration sensors, or any other suitable acoustic transducers that are positioned at one or more locations in or around sound sensing module 144. For example, according to the illustrated embodiment, sound sensing module 144 includes an external housing 162 that is positioned on top of or remote from microwave oven 100. Similarly, microphone 160 may be an existing appliance microphone repurposed to implement the methods described herein. It should be appreciated that according to alternative exemplary embodiments, any suitable microphone or system of audio detection devices may be positioned at any suitable location within audible range of microwave oven 100 and/or other appliances 146 for implementing methods described herein. In this regard, for example, microphone 160 may be positioned elsewhere within the room or residence where microwave oven 100 is located. In this manner, sound sensing module 144 may be positioned remote from microwave oven 100 and other appliances 146, such as at a central location within audible range of a plurality of appliances.

Sound sensing module 144 may further include a controller, identified in FIG. 1 by reference numeral 164. Controller 164 may be the same or similar to controller 140 of microwave oven 100, except that it may be mounted within sound sensing module 144 and is configured for operating sound sensing module 144. In general, controller 164 is communicatively coupled with microphone 160 for receiving sound signals, analyzing such sound signals to identify sound signatures, and directing or implementing corrective or responsive action.

In addition, it should be appreciated that some or all of the sound processing and signature detection may be performed locally, remotely, or in any other distributed manner. In this regard, for example, controller 164 may include a sound processing module 166 that is operably coupled with microphone 160 and is programmed for receiving sound signals and analyzing those signals to identify sound signatures. Controller 164 may further include a database (or may perform sound training to populate a database, see e.g., process 500 in FIG. 6) with potential sound signatures for comparing with detected sound signatures. In this manner, controller 164 may associate a given sound signature with a corresponding event, action, characteristic, etc. In addition, or alternatively, controller 164 may include a wireless communication module 168 for communicating with a remote server, a remote device, etc.

Notably, the sounds generated during operation of microwave oven 100 and/or other appliances 146 may be associated with one or more operating conditions, failure modes, event occurrences, etc. For example, controller 140 of microwave oven 100 may be programmed to generate a particular sequence, tone, or frequency of sounds when an event occurs, such as the expiration of a cooking timer, the end of a cooking cycle, a reminder, a fault indication, or other event notifications. These sounds may be unique and identifiable, for example, by natural resonant frequencies, amplitudes, the time-based excitations, the excitation rate (e.g., the speed at which a particular sound is triggered), the time decay of the generated sound waves, or any other acoustic signature or characteristic.

Similarly, the sounds generated during operation of the appliance may include unique sounds from which operating characteristics may be determined. For example, during operation of microwave oven 100, food that is being cooked may generate recognizable voices, such as sizzling, popping, etc. Other appliances 146 may make other sounds that are also detectable or recognizable by sound sensing module 144. Sound sensing module 144 may be programmed for monitoring such appliances by listening for such sounds. For example, a refrigerator appliance may make a specific noise to indicate the need for a replacement filter or the refrigerator compressor may generate a particular noise when maintenance or replacement is needed. Sound sensing module 144 may be programmed for detecting these specific noises, as well as various other sounds generated by various other appliances. It should be appreciated that the present subject matter is not limited to the type, number, and configuration of appliances being monitored. As explained in more detail below, aspects of the present subject matter are directed to systems and methods for monitoring sounds generated by an appliance, identifying sound signatures that correspond to particular events or characteristics, and implementing a responsive action to those events or characteristics.

Now that the construction of microwave oven 100 and sound sensing module 144 according to exemplary embodiments have been presented, an exemplary method 200 of operating a sound sensing module will be described. Although the discussion below refers to the exemplary method 200 of operating sound sensing module 144 to monitor sounds generated by microwave oven 100, one skilled in the art will appreciate that the exemplary method 200 is applicable to the detection of sounds generated by any suitable number and type of appliances. In exemplary embodiments, the various method steps as disclosed herein may be performed by controller 164 or a separate, dedicated controller.

Figure 3:
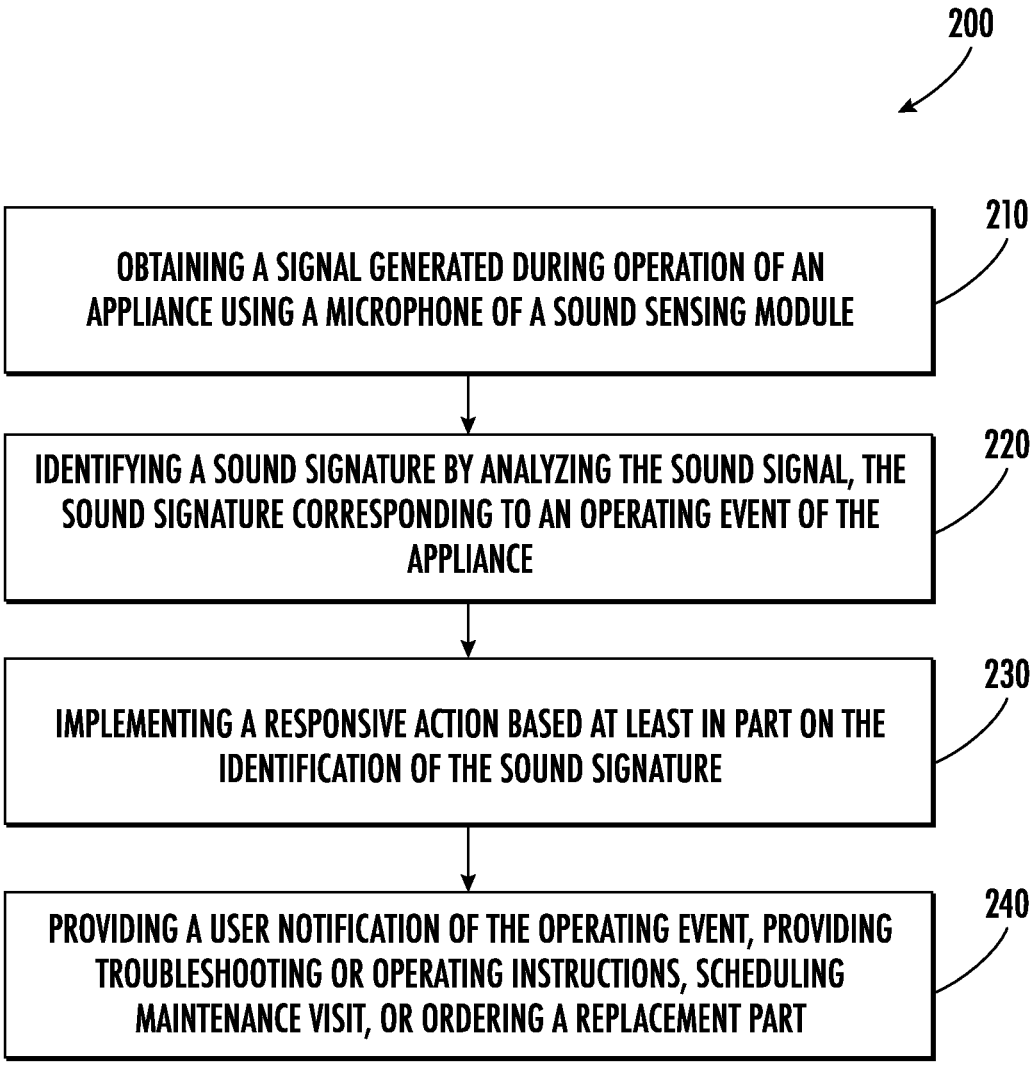
FIG. 3 provides a method of operating a sound sensing module according to an exemplary embodiment of the present subject matter.

Referring generally to FIG. 3, a method of operating a sound sensing module is provided. According to exemplary embodiments, method 200 includes, at step 210, obtaining a sound signal generated during operation of an appliance using a microphone. For example, continuing the example from above, microphone 160 may be used to detect noises, sounds, vibrations, or other acoustic waves generated during the operation of microwave oven 100 or other appliances 146. In addition, or alternatively, step 210 may include monitoring the sounds generated by appliances 100, 146 while they are not in operation, sounds generated during a diagnostic procedure, or any other suitable beeps, indicators, or sound waves that emanate from the appliances.

Step 220 includes identifying a sound signature by analyzing the sound signal, wherein the sound signature corresponds to an operating event or characteristic of the appliance. In this regard, as explained briefly above, microwave oven 100 may generate unique sounds depending on a particular operating event or characteristic. Sound sensing module 144 may obtain a sound signal of microwave oven 100 and may analyze that signal to identify that unique sound, e.g., referred to herein as the sound signature. As explained above, sound sensing module 144 may include a sound processing module 166 that is programmed for performing such sound analysis. In addition, or alternatively, sound sensing module 144 may be configured for communicating the sound signal to an external sound processing device, e.g., via wireless communication module 168 and network 156. This external sound processing device, which may be stored on remote server 154, may be configured for analyzing the sound signal to identify the sound signature.

It should be appreciated that the term "sound signature" may generally refer to any detectable sounds having any suitable amplitude, frequency, tone, etc. These sound signatures may be associated with an operating condition (e.g., such as end of cycle, timer expiration, etc.) or other device characteristics (e.g., worn components, service indications, etc.). The present subject matter is not intended to be limited to any particular number or type of sound signatures. In addition, any suitable sound recognition process or tool may be used to identify noise sources and operating conditions. For example, the sound recognition processes may rely on artificial intelligence, neural networks, machine learning, deep learning, or any other suitable sound processing and recognition techniques while remaining within the scope of the present subject matter.

In addition, it should be appreciated that the sound signal and/or sound signature may be converted into any suitable form, may be compressed, may be transmitted, and may otherwise be manipulated in any suitable manner to improve analysis. Moreover, sound processing module 144 may transmit some or all of the sound signal to an external processing device. In this regard, sound processing module 144 makes it easier or less data intensive to transmit and analyze sound signals. Thus, for example, sound processing module 144 may transmit the sound signal (e.g., or the compressed sound signal) to a remote server (e.g., such as remote server 154) for analysis. Sound processing module 144 may further be configured for receiving analytic feedback from remote server 154. In this manner, data processing may be offloaded from controller 164.

Sound sensing module 144 may use the identification of the sound signature for improving machine performance, e.g., by scheduling maintenance visits, adjusting operating parameters, providing user notifications, etc. Specifically, for example, step 230 includes implementing the responsive action based at least in part on the identification of the sound signature. For example, according to exemplary embodiments, implementing the responsive action comprises identifying service needs of the appliance and/or scheduling a maintenance visit, ordering a replacement part based on those service needs, instructing a user of the appliance.

According to another exemplary embodiment, implementing the responsive action may include instructing a user to adjust at least one operating parameter of the appliance based at least in part on the identification of the sound signature. In this regard, if a sound signature associated with a specific condition is identified at step 220, controller 164 may instruct the user take corrective action, e.g., by adjusting one or more operating parameters or implementing some other action in response to detecting that sound signature. In this regard, for example, controller 164 may provide troubleshooting instructions to the user on a cell phone, tablet, personal computer, smart home assistant, etc.

As used herein, an "operating parameter" of microwave oven 100 is any cycle setting, operating time, component setting, heat level, part configuration, or other operating characteristic that may affect the performance of microwave oven 100. Thus, references to operating parameter adjustments or "adjusting at least one operating parameter" are intended to refer to control actions intended to improve system performance based on the sound signature or other system parameters. For example, adjusting an operating parameter may include adjusting a cook time, adjusting a power level, modifying a cook sensing operation, stopping operation of the appliance, etc., based at least in part on the operating event. Other operating parameter adjustments are possible and within the scope of the present subject matter.

In addition, according to exemplary embodiments, adjusting an operating parameter may include providing a user notification when the sound signature indicates that a predetermined operating condition exists. For example, the operating event may be the expiration of the timer or an end of a cooking cycle, etc. In addition, the operating event may be a filter replacement indication, a fault indication, etc. For example, according to one exemplary embodiment, the sound signature may be associated with sounds generated by a faulty component, created during a particular operating condition, etc. In addition, controller 164 may use the sound signature to identify service needs, providing a user with operating guidance or troubleshooting instructions, etc. When a sound signature is generated that indicates a particular operating condition, e.g., such as a potential failure of a component, a user notification may be provided via sound sensing module 144 or directly to a user's remote device 152 (e.g., a cell phone, via wireless connection).

Figure 4:
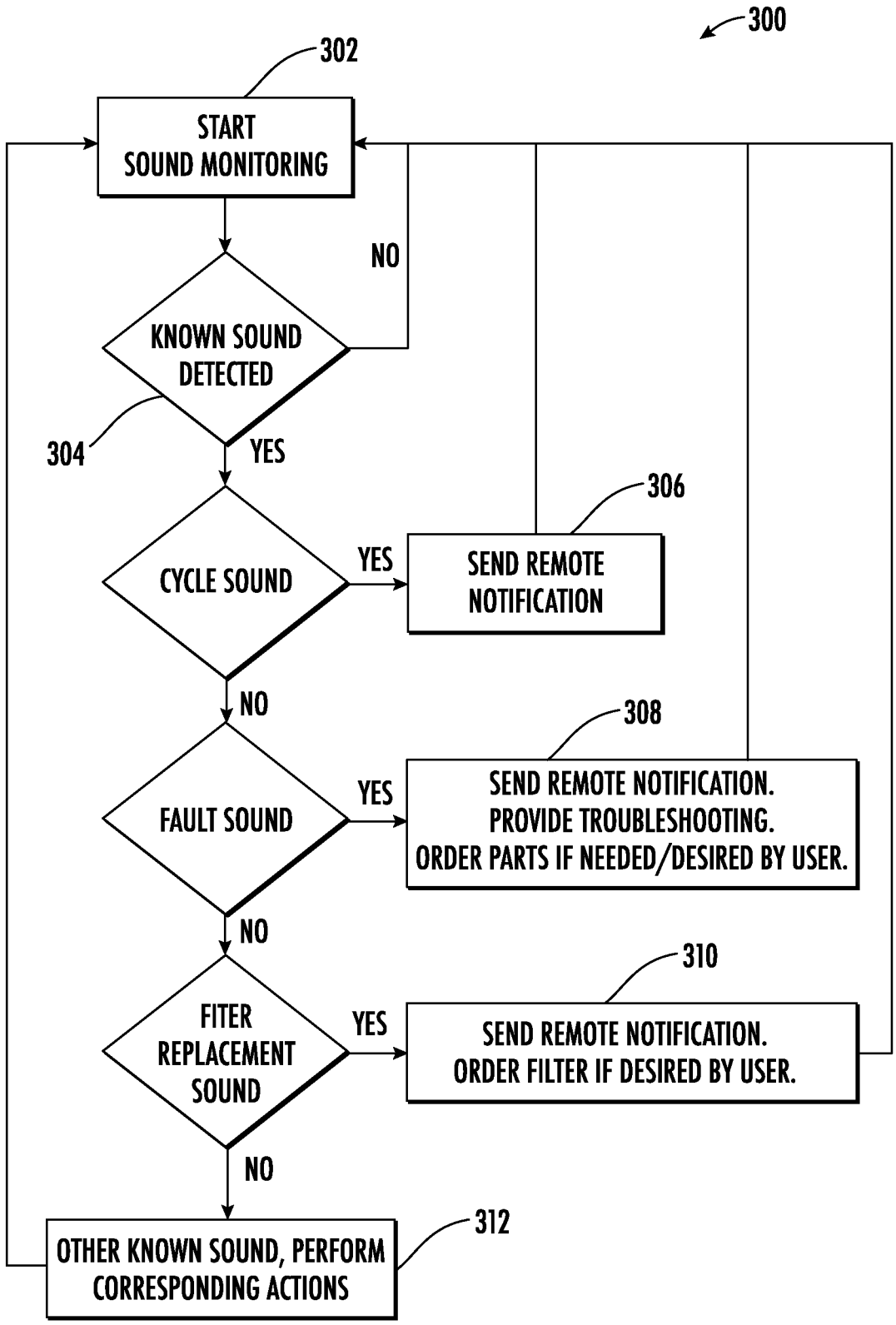
FIG. 4 provides an exemplary flow diagram or operating method for detecting sounds using the exemplary sound sensing module of FIG. 2 according to an exemplary embodiment of the present subject matter.

Referring now briefly to FIG. 4, an exemplary flow diagram illustrating sound signature detection and remote notification is illustrated. As shown, this signature detection method 300 includes, at step 302, starting a sound monitoring process. Sound may be monitored continuously until a known sound is detected at step 304. In the event the sound signature corresponds to a cycle sound, step 306 may include sending a remote notification, e.g., to a user's remote device 152. In the event the sound signature corresponds to a fault sound, step 308 may include sending remote notification, providing troubleshooting instructions, ordering parts if needed, etc. Similarly, if the sound signature corresponds to a filter replacement indicator, step 310 may include sending remote notification and/or ordering a filter, e.g., if auto-ordering is permitted by the user. As shown by step 312, if sound signature corresponds to any other event or operating characteristic, controller 164 may be configured to perform any other suitable responsive action.

According to exemplary embodiments, notifications such as faults and parts ordering may always be enabled in sound sensing module 144. According to still other embodiments, these notifications (and others) may be configured by the user.

Figure 5:
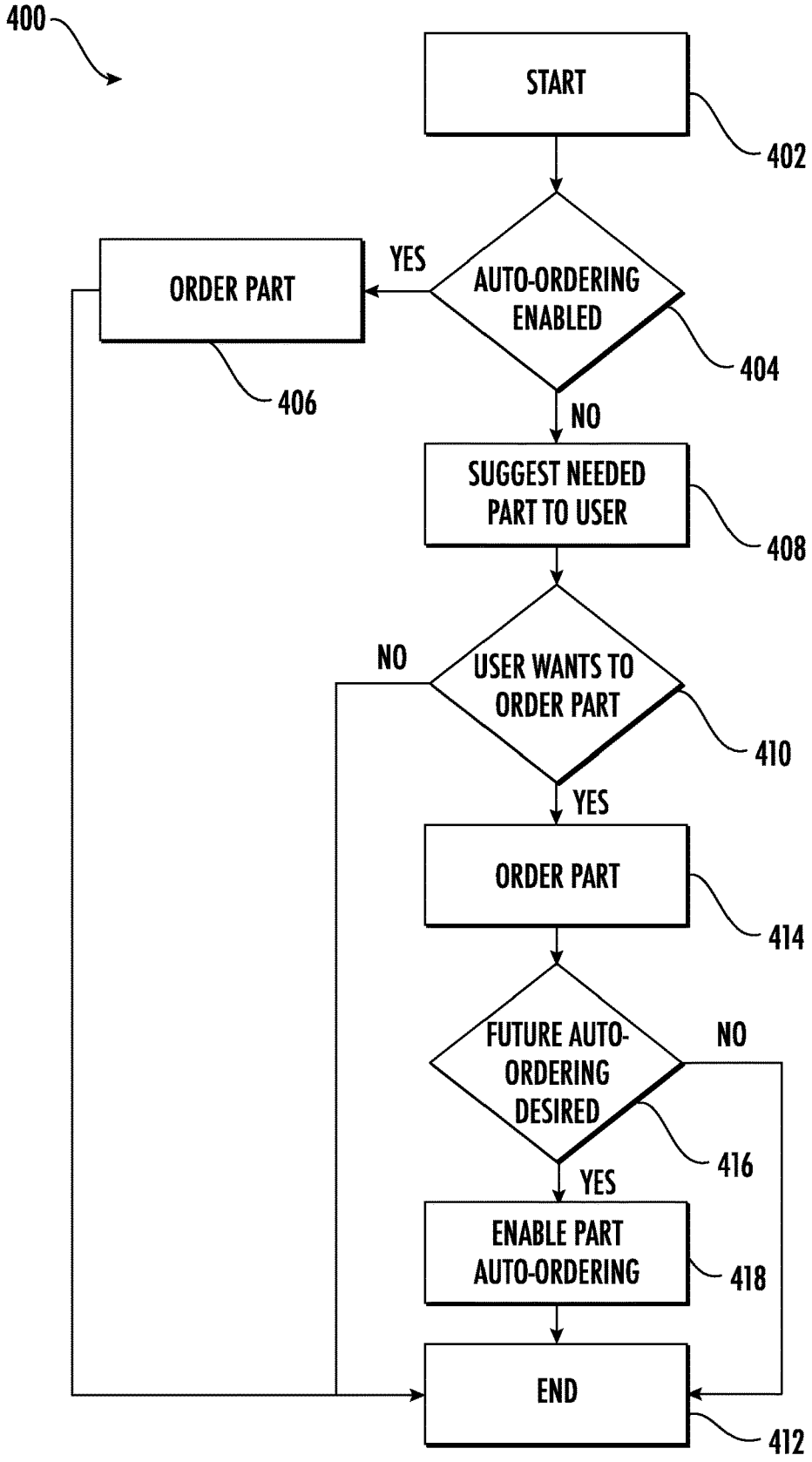
FIG. 5 provides an exemplary flow diagram or operating method for identifying maintenance needs and facilitating part ordering using the exemplary sound sensing module of FIG. 2 according to an exemplary embodiment of the present subject matter.

Referring now briefly to FIG. 5, an exemplary flow diagram illustrating a part replacement process based on the sound signatures is provided. As shown, the part replacement process 400 may include determining that a part replacement is needed at step 402 (e.g., as determined at step 308 or 310 from the signature detection method 300). Process 400 may further include determining whether auto-ordering is enabled at step 404. If auto-ordering is enabled, step 406 may include ordering the part automatically. By contrast, if auto-ordering is not enabled step 408 may include suggesting part replacement to the user of the appliance, e.g., via remote device 152. At step 410, a user may respond to the suggestion or notification. If the user declines to order the part, step 412 is the end of the part ordering process. By contrast, if the user wants to order the part (e.g., as confirmed using remote device 152), a part may be ordered at step 414. After making such an order, process 400 may include suggesting to the user that auto-ordering be turned on for future orders. Specifically, at step 416, process 400 may include asking the user whether future auto-ordering is desired. If not, process 400 may end at step 412. However, if a user indicates that auto-ordering is desired, automatic part ordering may be enabled at step 418.

Notably, controller 164 may further be configured for learning a plurality of sound signatures associated with microwave appliance 100 and/or other appliances 146. For example, common conditions or operating noises may be intentionally generated to train a neural network or other artificial intelligence model. That model may then be used to detect particular sound signatures associated with particular events. Such sound signatures may be stored locally on controller 164 or on a remote server 154. In addition, sound signatures may be appliance specific, may be stored according to a particular model or appliance configuration, or may be associated with a microwave appliance or another appliance in any other suitable manner.

Figure 6:
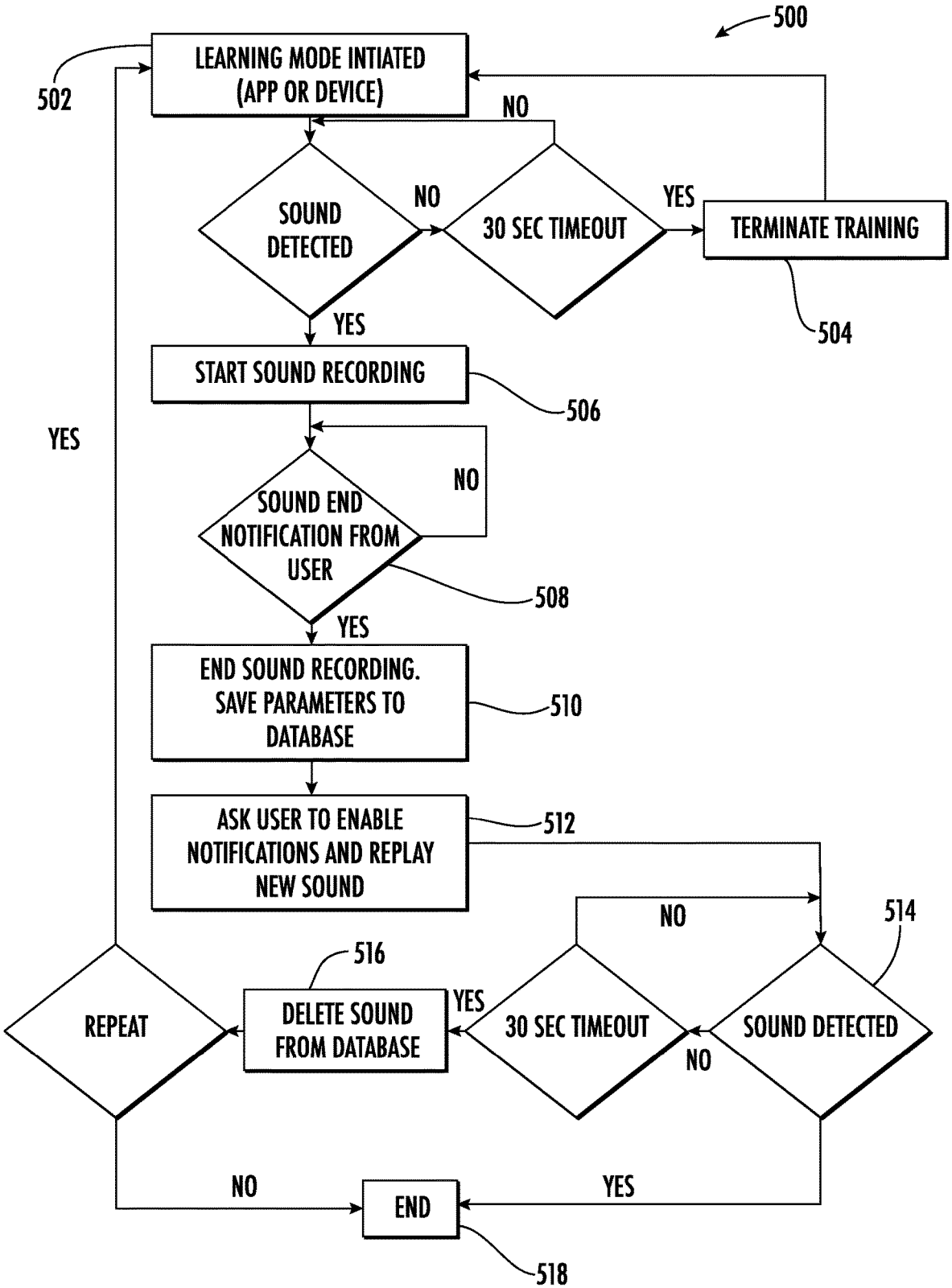
FIG. 6 provides an exemplary flow diagram or operating method for listening for a learning sounds associated with particular operating conditions using the exemplary sound sensing module of FIG. 2 according to an exemplary embodiment of the present subject matter.

Specifically, referring briefly to FIG. 6, an exemplary method of training a sound sensing module 144 is illustrated according to an exemplary embodiment. As shown, training method 500 may include initiating the learning mode at step 502. This initiation may come in the form of voice command, from the user, through an input via a smart home assistant, or via an application on a remote device 152. Once learning mode is initiated at step 502, the sound processing module 166 may monitor sounds until a sound is detected. If no sound is detected within a certain time period, e.g., 30 seconds, step 504 may include terminating the training mode. By contrast, if a sound is detected, step 506 may include starting a sound recording. According to an exemplary embodiment, the sound recording may continue until a notification is received from the user at step 508, indicating that the sound has stopped. Subsequently, step 510 may include ending the sound recording and saving the sound signal to a database.

Learning mode 500 may further include steps for confirming that the proper sound signature is recorded within the database. In this regard, step 512 may include asking a user to enable notifications and replay the new sound. As the new sound is being replayed, step 514 includes determining whether the sound is detected. If the new sound is not detected within a certain predetermined timeout period, e.g., 30 seconds, the sound signature may be deleted from the database at step 516, and the process may be repeated. By contrast, if the sound signature is detected at step 514, the sound signature is verified and may remain within the database, after which the process ends at step 518.

FIGS. 3 through 6 depict steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of these methods are explained using microwave appliance 100 as an example, it should be appreciated that these methods may be applied to the operation of any suitable appliance or a plurality of appliances.

The systems and method described above facilitate improved appliance operation and user interaction. In this regard, for example, sound sensing module 144 may monitor sounds generated by a nearby microwave appliance or any other suitable appliances. Sound sensing module 144 may then identify sound signatures generated by such appliances that correspond to events or conditions. Furthermore, sound sensing module 144 may provide a user with operating guidance, troubleshooting instructions, or other advice for improved operation. In addition, sound sensing module may order replacement parts, schedule maintenance visits, and learn sounds associated with events or conditions. In this manner, sound sensing module 144 may be used with older appliances that are not "smart" or networked appliances. Using sound sensing module 144 as described herein may effectively impart these "smart" functionalities to any suitable appliance for improved operation and user interaction. In other words, aspects of the present subject matter may improve operation and maintenance of microwave oven 100 and other appliances 146 without requiring that these appliances have any type of network communication (e.g., no Wi-Fi, Bluetooth, etc.) or smart capabilities.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A sound sensing module for monitoring the operation of a plurality of non-networked appliances, the sound sensing module comprising:

an external housing positioned remote from the plurality of non-networked appliance and within audible range of the plurality of non-networked appliances;

a microphone positioned within the external housing for monitoring sound generated during operation of the plurality of non-networked appliances; and a controller operably coupled to the microphone, the controller being configured to:

obtain a sound signal generated during operation of the plurality of non-networked appliances using the microphone;

identify a sound signature by analyzing the sound signal, the sound signature corresponding to an operating event of a target appliance of the plurality of non-networked appliances; and implement a responsive action with respect to the target appliance based at least in part on the identification of the sound signature.

2. The sound sensing module of claim 1, wherein the operating event is the expiration of a timer, an end of a cooking cycle, a filter replacement indication, or a fault indication.

3. The sound sensing module of claim 1, wherein implementing the responsive action comprises:

identifying service needs of the target appliance; and scheduling a maintenance visit or ordering a replacement part.

4. The sound sensing module of claim 1, wherein the controller is further configured to:

provide a user notification of the operating event.

5. The sound sensing module of claim 1, wherein implementing the responsive action comprises:

instructing a user to adjust at least one operating parameter of the target appliance.

6. The sound sensing module of claim 5, wherein instructing the user to adjust the at least one operating parameter comprises:

instructing the user to stop operation of the target appliance or select an operating cycle based on the sound signature.

7. The sound sensing module of claim 1, wherein the controller is further configured to:

provide a user of the appliance with troubleshooting instructions or operating instructions.

8. The sound sensing module of claim 1, wherein the controller is further configured to:

learn a plurality of sound signatures associated with various operating conditions of the plurality of non-networked appliances.

9. The sound sensing module of claim 1, wherein the controller comprises:

a sound processing module operably coupled with the microphone for identifying the sound signature by comparing the sound signal to a plurality of sound signatures.

10. The sound sensing module of claim 1, wherein the controller comprises:

a wireless communication module for communicating with at least one of a remote server or a remote device.

11. The sound sensing module of claim 1, wherein the controller is further configured to:

transmit the sound signal or the sound signature to a remote server for analysis; and receive feedback from the remote server regarding the operating event.

12. The sound sensing module of claim 1, wherein the target appliance is a microwave oven.

13. A method of monitoring the operation of a plurality of non-networked appliances using a sound sensing module, the sound sensing module comprising an external housing positioned remote from the plurality of non-networked appliance and within audible range of the plurality of non-networked appliances and a microphone positioned within the external housing for monitoring sound generated during operation of the plurality of non-networked appliances, the method comprising:

obtaining a sound signal generated during operation of the plurality of non-networked appliances using the microphone;

identifying a sound signature by analyzing the sound signal, the sound signature corresponding to an operating event of a target appliance of the plurality of non-networked appliances; and implementing a responsive action with respect to the target appliance based at least in part on the identification of the sound signature.

14. The method of claim 13, wherein the operating event is the expiration of a timer, an end of a cooking cycle, a filter replacement indication, or a fault indication.

15. The method of claim 13, wherein implementing the responsive action comprises:

identifying service needs of the target appliance; and scheduling a maintenance visit or ordering a replacement part.

16. The method of claim 13, further comprising:

providing a user of the target appliance with a user notification of the operating event, troubleshooting instructions, or operating instructions.

17. The method of claim 13, wherein implementing the responsive action comprises:

instructing a user to adjust at least one operating parameter of the target appliance.

* * * * *